US010343263B2

(12) United States Patent
Liu

(10) Patent No.: US 10,343,263 B2
(45) Date of Patent: Jul. 9, 2019

(54) V-SHAPED BIONIC WRENCH

(71) Applicant: Shenzhen Zijinwang Technology Co., Ltd., Shenzhen, Guangdong Province (CN)

(72) Inventor: Fengyi Liu, Shenzhen (CN)

( * ) Notice: Subject to any disclaimer, the term of this patent is extended or adjusted under 35 U.S.C. 154(b) by 228 days.

(21) Appl. No.: 15/503,896

(22) PCT Filed: Sep. 8, 2015

(86) PCT No.: PCT/CN2015/089157
§ 371 (c)(1),
(2) Date: Feb. 14, 2017

(87) PCT Pub. No.: WO2016/037561
PCT Pub. Date: Mar. 17, 2016

(65) Prior Publication Data

US 2017/0232584 A1 Aug. 17, 2017

(30) Foreign Application Priority Data

Sep. 9, 2014 (CN) ..... 2014 2 0513073 U

(51) Int. Cl.
*B25B 13/14* (2006.01)

(52) U.S. Cl.
CPC ..... *B25B 13/14* (2013.01)

(58) Field of Classification Search
CPC ..... B25B 13/14
See application file for complete search history.

(56) References Cited

U.S. PATENT DOCUMENTS 452,410 A * 5/1891 Hitt ..... B25B 13/14 81/158
525,683 A * 9/1894 Friede ..... B25B 13/14 81/165
575,592 A * 1/1897 Canfield ..... B25B 13/14 81/165
873,859 A * 12/1907 Hachmann ..... B25B 13/14 81/107
886,448 A * 5/1908 Wakefield ..... B25B 13/14 81/158
967,355 A * 8/1910 Ewer ..... B25B 13/14 81/158
1,032,035 A * 7/1912 Ver Beck ..... B25B 13/14 81/100

(Continued)

*Primary Examiner* — David B. Thomas
(74) *Attorney, Agent, or Firm* — Novoclaims Patent Services LLC; Mei Lin Wong

(57) ABSTRACT

A V-shaped bionic wrench which a handle, a fixed jaw, a movable jaw, a worm and a rack. The movable jaw is disposed on the rack. The worm is engaged with the rack and disposed on the handle. The gripping faces of the movable jaw and the fixed jaw form a V-shaped opening. In use, the gripping faces of the movable jaw and the fixed jaw of the wrench form a V-shaped opening, avoiding the trouble, when screwing an object with a conventional adjustable wrench, of repeatedly adjusting the worm to find the distance at which the wrench is to be opened, and achieving the precise gripping in one step upon insertion into the V-shaped opening, thereby allowing quick and convenient use. In addition, screwing can also be implemented when an object is held at the top of the V-shaped opening, thus saving operating space compared with a conventional wrench.

12 Claims, 4 Drawing Sheets

(56) References Cited

U.S. PATENT DOCUMENTS

| | | | | | | |
|---|---|---|---|---|---|---|
| 1,060,891 | A | * | 5/1913 | Carll | B25B 13/14 | 81/165 |
| 1,169,870 | A | * | 2/1916 | Riexinger | B25B 13/14 | 81/165 |
| 1,212,287 | A | * | 1/1917 | Upson | B25B 13/14 | 81/157 |
| 1,362,481 | A | * | 12/1920 | Dobbins | B25B 7/02 | 81/179 |
| 1,557,864 | A | * | 10/1925 | Mull | B25B 13/12 | 81/165 |
| 1,564,411 | A | * | 12/1925 | Fones | B25B 13/12 | 81/158 |
| 1,648,653 | A | * | 11/1927 | McDonald | B25B 13/12 | 81/106 |
| 1,747,360 | A | * | 2/1930 | Giles | B25B 13/14 | 81/157 |
| 2,820,385 | A | * | 1/1958 | Schulze | B25B 7/04 | 81/185.1 |
| 3,012,457 | A | * | 12/1961 | Powell | B25B 13/12 | 81/165 |
| 3,868,875 | A | * | 3/1975 | Evans | B25B 13/14 | 81/158 |
| 4,344,339 | A | * | 8/1982 | Penner | B25B 13/14 | 81/157 |

* cited by examiner

V-SHAPED BIONIC WRENCH

BACKGROUND OF THE INVENTION

Technical Field

The present invention relates to a manual tool, specifically to a V-shaped bionic wrench.

Description of Related Art

Conventional wrenches can screw hexagonal nuts and tetragonal nuts only, and do not work on tubular objects and nuts of other shapes. When a nut is rusted, if the wrench has an insufficient action force, the rusted nut cannot usually be loosened and it is possible that the wrench will slip and damage the nut profile. Besides, the resetting operation is very difficult after the conventional wrench completes the nut screwing at one time. Usually, it is needed to open the wrench to release the nut, reset the wrench, clamp the nut again and repeat the nut screwing operation. Besides, when a conventional wrench is used to screw an object, it is needed to repeatedly adjust the worm to find the opening length of the wrench. Moreover, during the repeated clamping process, the wrench opening greatly tends to loosen. Such operation causes huge difficulties during working. Pipe tongs are mainly applicable to tubular objects. Pipe tongs are relatively heavy and both faces of the pipe tongs have teeth, which cause large damage to the screwed object. Therefore, the service scope of pipe tongs is limited.

BRIEF SUMMARY OF THE INVENTION

The objective of the present invention is to provide a V-shaped bionic wrench which can reset directly and is applicable to various nuts and tubular objects.

To achieve the above objective, the technical solution of the present invention is as follows.

A V-shaped bionic wrench includes a handle, and a fixed jaw, a movable jaw, a worm and a rack which are disposed on the handle. The movable jaw is disposed on the rack. The worm is engaged with the rack and disposed on the handle. The gripping faces of the movable jaw and the fixed jaw form a V-shaped opening.

The fixed jaw includes a fixed jaw body and a wedged slide block; the wedged slide block is fixedly disposed on the fixed jaw body; and the gripping face of the wedged side block and the gripping face of the movable jaw form the V-shaped opening.

The fixed jaw includes a fixed jaw body, a wedged slide block and a columnar slide rail; the columnar slide rail is fixedly disposed on the surface of the wedged slide block that is opposite to the gripping face; the fixed jaw body is formed with a slide rail hole capable of accommodating the columnar slide rail; and the gripping face of the wedged slide block and the gripping face of the movable jaw form the V-shaped opening.

The V-shaped bionic wrench further includes a spring and a spring bolt; a spring hook is disposed at the front end of the columnar slide rail; the spring bolt is inserted into the fixed jaw body from the outside and exactly positioned at the rear end of the columnar slide rail; and the spring has one end suspended on the spring hook and the other end suspended on the spring bolt.

The V-shaped bionic wrench further includes a stop bolt; a stop block is respectively disposed at each of the two ends of the columnar slide rail; the spring is positioned between the two stop blocks; the stop bolt penetrates the fixed jaw body and is exactly positioned between the spring bolt and the stop block at the tail end of the columnar slide rail.

Optimally, the gripping face of the wedged slide block is a saw-toothed slope face.

Optimally, the gripping face of the wedged slide block has a root formed as a plane and a saw-toothed slope face formed above from the root.

ADVANTAGEOUS EFFECT OF THE PRESENT INVENTION

Advantageous effect

In use, the gripping faces of the movable jaw and the fixed jaw of the wrench form the V-shaped opening, avoiding the trouble, when screwing an object with a conventional adjustable wrench, of repeatedly adjusting the worm to find the distance at which the wench is to be opened, and achieving the precise gripping in one step upon insertion into the V-shaped opening, thereby allowing quick and convenient use. In addition, screwing can also be implemented when an object is held at the top of the V-shaped opening, thus saving operating space compared with a conventional wrench. The V-shaped bionic wrench is applicable in operating large nuts while also facilitating fastening. By utilizing the V shape gripping generated by the saw-toothed face and the plane for gripping, not only is the wrench made easy to reset, but a nut never slips when screwed tight. The structural design of the wedged slide block increases the stress area of the screwed object, provides more stress directions and applies more uniform stress, thus achieving flexible operation of the screwed object in a small space; besides, the wrench of the present invention works on nuts and tubular objects which cannot be unfastened by conventional wrenches, and overcomes the defects of large weight and damage to screwed objects caused by pipe tongs.

DETAILED DESCRIPTION OF THE INVENTION

To make the objectives, technical solution and advantages of the present invention more clear, the present invention is described in further detail with reference to the following attached drawings and embodiments. It should be understood that the embodiments depicted here are only illustrative, and do not limit the present invention.

Embodiment 1

Figure 1:
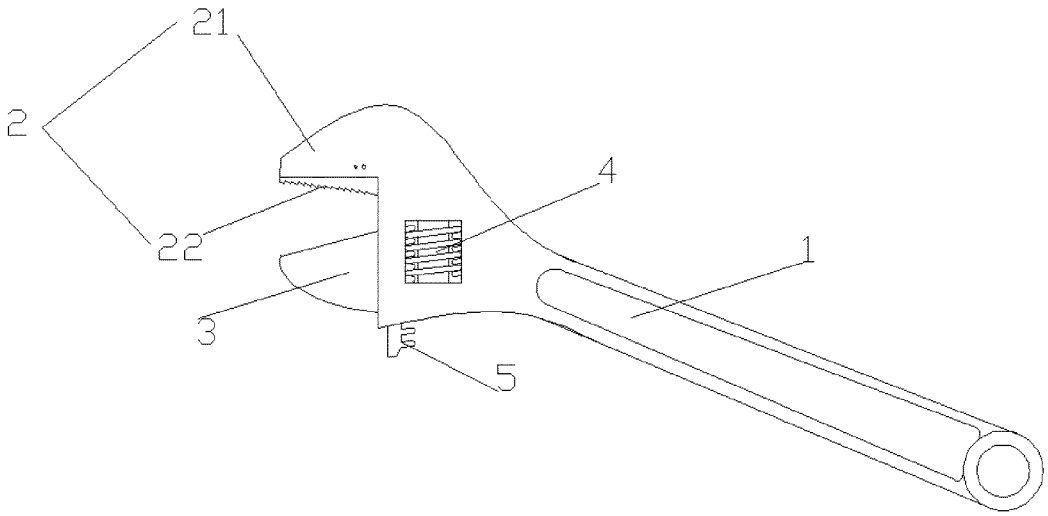
FIG. 1 is a schematic view of the appearance of embodiment 1 of the present invention.

Refer to FIG. 1. A V-shaped bionic wrench is disclosed, including a handle 1, and a fixed jaw 2, a movable jaw 3, a worm 4 and a rack 5 which are disposed on the handle 1, wherein the fixed jaw 2 includes a fixed jaw body 21 and a wedged slide block 22; the wedged slide block 22 is integrally molded with the fixed jaw body 21; the gripping face of the wedged block slide 22 is shaped as a saw-toothed slope face, together with the gripping face of the movable jaw 3 forming a V-shaped opening.

The movable jaw 3 is disposed on the rack 5; the worm 4 is engaged with the rack 5; and the worm 4 and the rack 5 are disposed on the handle 1.

In use, by adjusting the worm 4, the rack 5 drives the movable jaw 3 to move to a proper position and to sleeve the V-shaped opening on an object to be screwed. The V-shaped opening wrench of the present invention can perform accurate gripping at one time, and therefore is quick and convenient.

Embodiment 2

Figure 2:
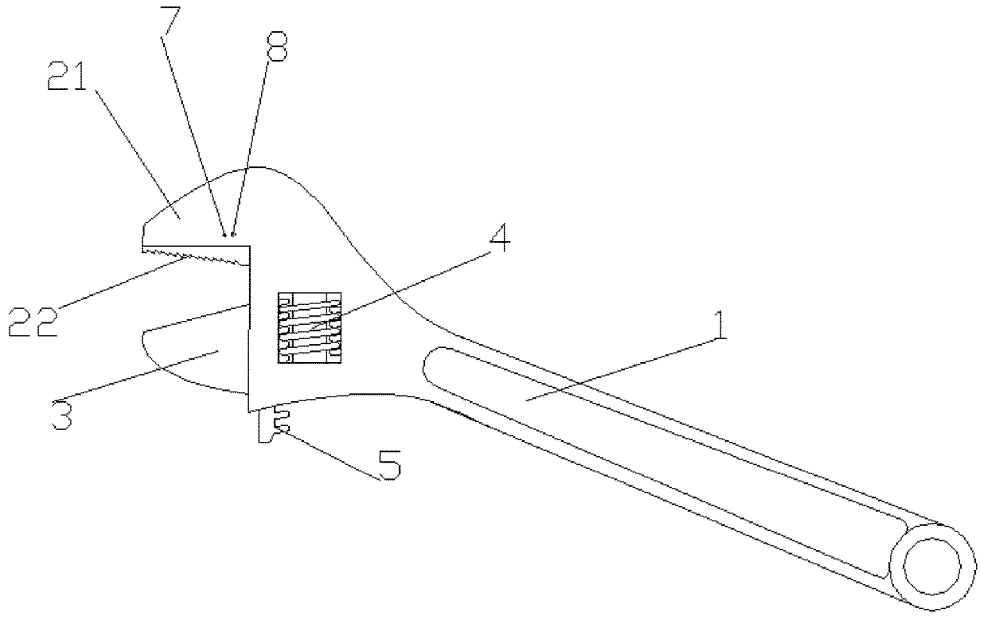
FIG. 2 is a schematic view of the appearance of embodiment 2 of the present invention.
Figure 3:
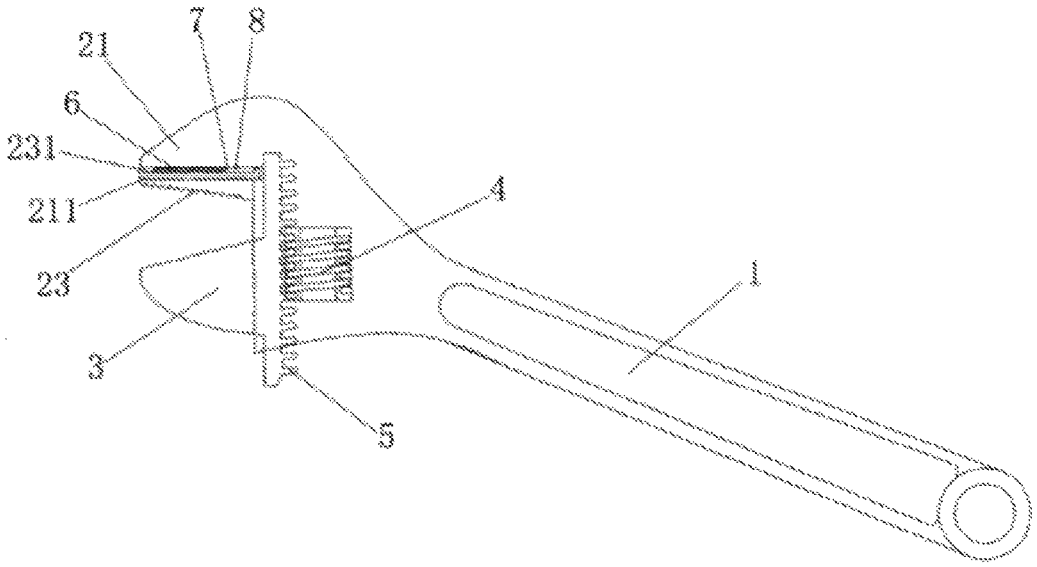
FIG. 3 is a sectional view of embodiment 2 of the present invention.

Refer to FIG. 2 and FIG. 3 which show embodiment 2 of the present invention. Compared with embodiment 1, embodiment 2 is different in that:

the fixed jaw 2 includes a fixed jaw body 21, a wedged slide block 22 and a columnar slide rail 23; the columnar slide rail 23 is fixedly disposed on the surface of the wedged slide block 22 that is opposite to the gripping face; the fixed jaw body 21 is formed with a slide rail hole 211 capable of accommodating the columnar slide rail 23; and the gripping face of the wedged slide block 22 and the gripping face of the movable jaw 3 form the V-shaped opening.

Figure 4:
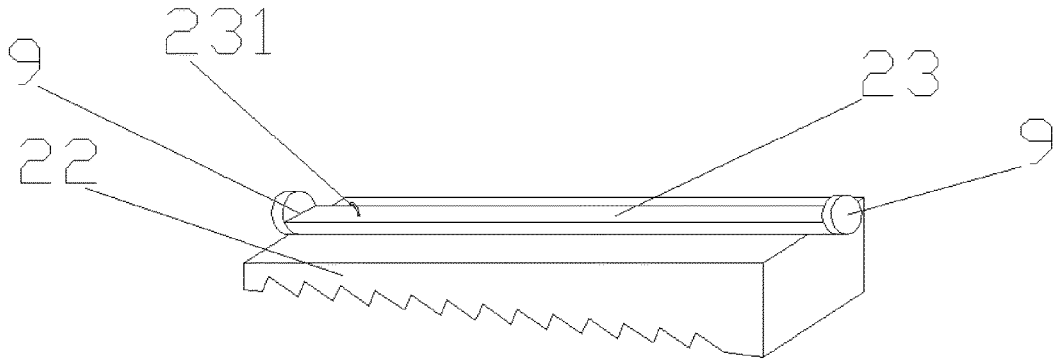
FIG. 4 is a three-dimensional view of a wedged slide block of embodiment 2 of the present invention.

Refer to FIG. 3 and FIG. 4. A spring 6, a spring bolt 7, a stop bolt 8 and stop blocks 9 are further comprised; a spring hook 231 is disposed at the front end of the columnar slide rail 23; the spring bolt 7 is inserted into the fixed jaw body 21 from the outside; the spring 6 has one end suspended on the spring hook 231, and the other end suspended on the spring bolt 7.

Two stop blocks 9 are provided, respectively disposed at two ends of the columnar slide rail 23. After the assembling is completed, the spring 6 and the spring bolt 7 are both disposed between the two stop blocks 9. Moreover, the stop bolt 8 penetrates the fixed jaw body 21 and is exactly disposed between the spring bolt 7 and the stop block 9 at the tail end of the columnar slide rail 23.

Figure 5:
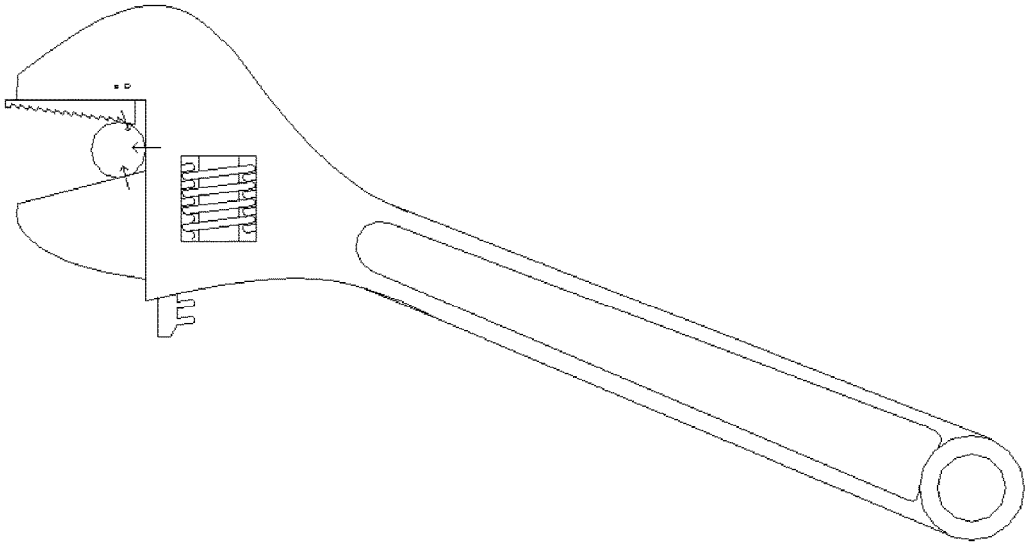
FIG. 5 is a schematic view of stress applied by a bionic wrench to a tubular element of embodiment 2 of the present invention.
Figure 6:
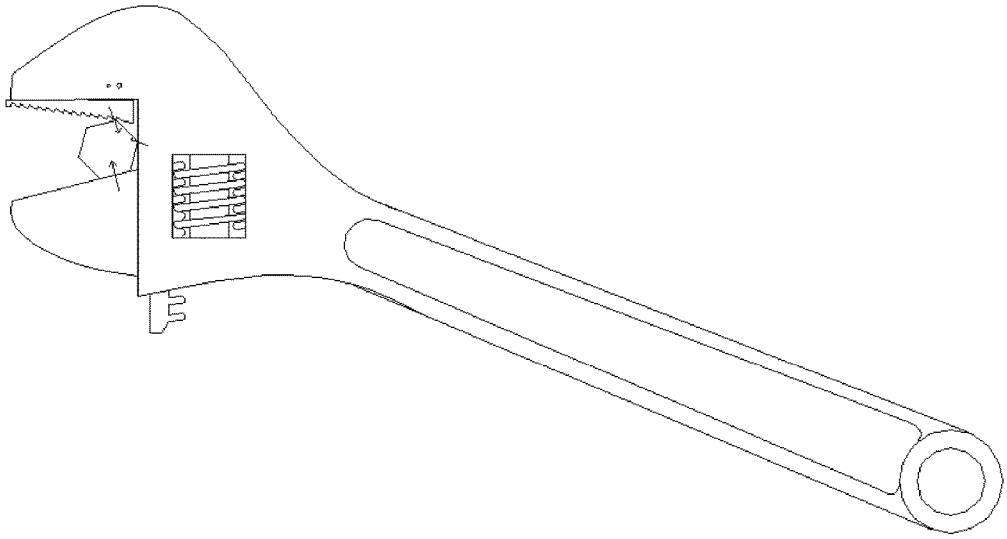
FIG. 6 is a schematic view of stress applied by a bionic wrench to a hexagonal nut of embodiment 2 of the present invention.

In use, refer to FIGS. 5 and 6. The spring bolt 7 is fixedly disposed on the fixed jaw body 21, and the spring 6 has one hand fixed with the spring bolt 7 and the other end suspended on the spring hook 231. Therefore, during use of the wrench, in the process where the wedged slide block 22 is pushed by an outward thrust of the screwed object to properly move outward, the spring 6 can drive the wedged slide block 22 to reset when the outward thrust disappears. Besides, due to the configuration of the stop bolt 8, the wedged slide block 22 has a certain movement space, namely limit positions, which means that the stop blocks 9 can move to the bottom end of the slide rail hole 211, or the stop blocks 9 move to contact the stop bolt 8. With the movement space, the wrench of the present invention can effectively adjust the engaged position between the wrench and an object according to the shape of the object, and then the screwed object is optimally tightly engaged with the wrench, so the contact area of the V-shaped bionic wrench on the screwed object increases greatly. Compared with a common wrench, the V-shaped bionic wrench of the present invention can increase the stress area when screwing the same object with the same force, and then the stress on a unit area of the object is reduced, thus effectively avoiding the screwed object from deforming because of too much stress. Similarly, due to the increase in the contact area between the V-shaped bionic wrench and the screwed object, the stress limit scope of the object screwed with the V-shaped bionic wrench also increases, thus avoiding the problem that many objects suffer worn deformation and screwing failure when screwed with conventional wrenches.

Embodiment 3

Figure 7:
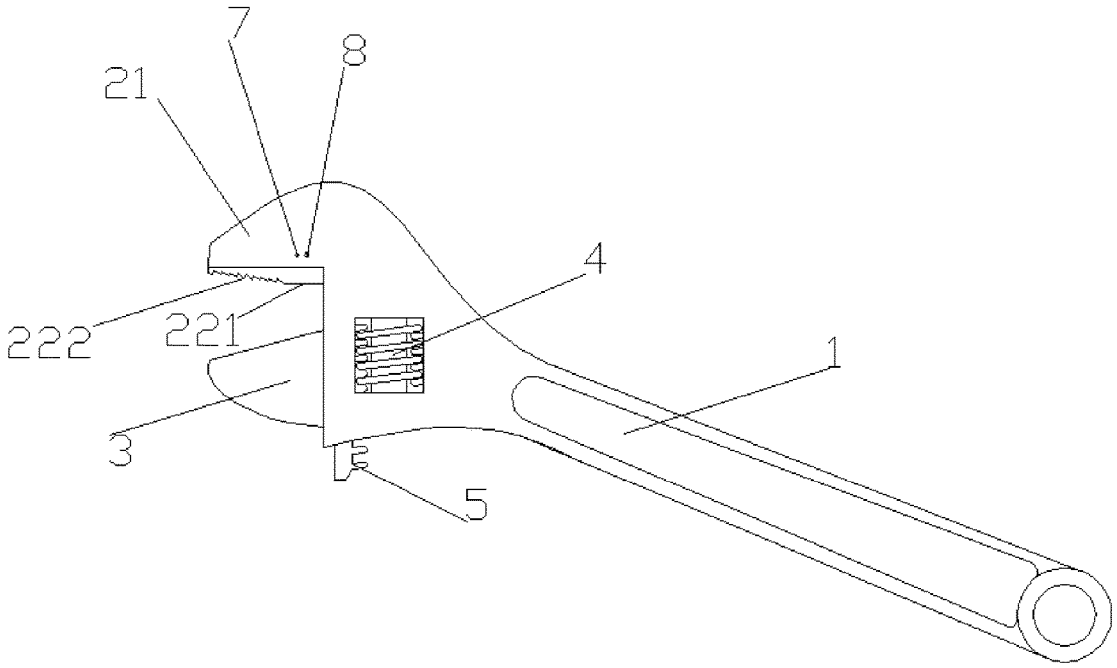
FIG. 7 is a schematic view of the appearance of embodiment 3 of the present invention.

Refer to FIG. 7 which shows embodiment 3 of the present invention. Compared with embodiment 2, embodiment 3 is different in that:

the gripping face of the wedged slide block 22 has a root 211 formed as a plane and a saw-toothed slope face 222 formed above from the root.

By such structure, a bigger force is needed when a nut is screwed to the final position. At this time, the nut is positioned at the planar structure of the wrench, and the plane of the nut contacts the planar structure, thus avoiding damage to the nut when a bigger force is applied.

Embodiment 4

Figure 8:
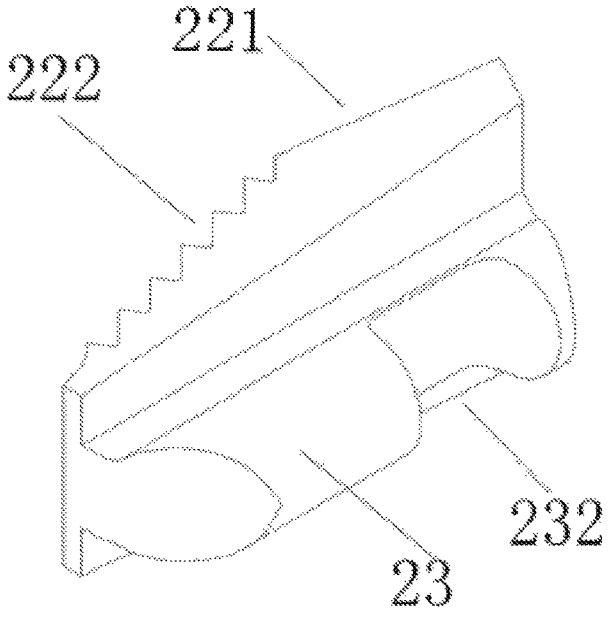
FIG. 8 is a structural view of a wedged slide block of embodiment 4 of the present invention.

Refer to FIG. 8, which is a structural view of the wedged slide block of embodiment 4 of the present invention. Compared with embodiment 2, embodiment 4 is different in that:

the wedged slide block 22 is integrally molded with the columnar slide rail 23; the columnar slide rail 23 is formed with a recession 232; and the stop bolt 8 is exactly positioned in the middle of the recession 232 after penetrating the fixed jaw body 21. In use, when the wedged slide block 22 is pushed by an outward thrust of the screwed object to properly move outward, the stop bolt 8 moves in the space of the recession 232.

The above embodiments are preferable embodiments of the present invention, but the protective scope of the present invention is not limited to the embodiments. Any changes or substitutions that are easily made by those skilled in this field within the technical scope of the present invention shall fall within the protective scope of the present invention. Therefore, the protective scope of the present invention is subject to that of the claims.

What is claimed is:

1. A V-shaped bionic wrench, comprising a handle, and a fixed jaw, a movable jaw, a worm and a rack which are disposed on the handle, wherein the movable jaw is disposed on the rack; the worm is engaged with the rack and disposed on the handle; and the gripping faces of the movable jaw and the fixed jaw form a V-shaped opening, the fixed jaw includes a fixed jaw body, a wedged slide block and a columnar slide rail; the columnar slide rail is fixedly disposed on the surface of the wedged slide block that is opposite to the gripping face; the fixed jaw body is formed with a slide rail hole capable of accommodating the columnar slide rail; and the gripping face of the wedged slide block and the gripping face of the movable jaw form the V-shaped opening.

2. The V-shaped bionic wrench according to claim 1, characterized by further comprising a spring and a spring bolt, wherein a spring hook is disposed at the front end of the columnar slide rail; the spring bolt is inserted into the fixed jaw body from the outside and exactly positioned at the rear end of the columnar slide rail; and the spring has one end suspended on the spring hook and the other end suspended on the spring bolt.

3. The V-shaped bionic wrench according to claim 2, characterized by further comprising a stop bolt, wherein a stop block is respectively disposed at each of the two ends of the columnar slide rail; the spring is positioned between the two stop blocks; the stop bolt penetrates the fixed jaw body and is exactly positioned between the spring bolt and the stop block at the tail end of the columnar slide rail.

4. The V-shaped bionic wrench according to claim 3, characterized in that the gripping face of the wedged slide block is a saw-toothed slope face.

5. The V-shaped bionic wrench according to claim 3, characterized in that the gripping face of the wedged slide block has a root which is formed as a plane parallel to the gripping face of the movable jaw, and has a saw-toothed slope face formed above from the root.

6. The V-shaped bionic wrench according to claim 2, characterized in that the gripping face of the wedged slide block is a saw-toothed slope face.

7. The V-shaped bionic wrench according to claim 2, characterized in that the gripping face of the wedged slide block has a root which is formed as a plane parallel to the gripping face of the movable jaw, and has a saw-toothed slope face formed above from the root.

8. The V-shaped bionic wrench according to claim 1, characterized by further comprising a stop bolt, wherein the wedged slide block is integrally molded with the columnar slide rail; the column slide rail is formed with a recession; and the stop bolt penetrates the fixed jaw body and is exactly positioned in the recession.

9. The V-shaped bionic wrench according to claim 8, characterized in that the gripping face of the wedged slide block is a saw-toothed slope face.

10. The V-shaped bionic wrench according to claim 8, characterized in that the gripping face of the wedged slide block has a root which is formed as a plane parallel to the gripping face of the movable jaw, and has a saw-toothed slope face formed above from the root.

11. The V-shaped bionic wrench according to claim 1, characterized in that the gripping face of the wedged slide block is a saw-toothed slope face.

12. The V-shaped bionic wrench according to claim 1, characterized in that the gripping face of the wedged slide block has a root which is formed as a plane parallel to the gripping face of the movable jaw, and has a saw-toothed slope face formed above from the root.

* * * * *